US006447083B1

(12) United States Patent
Chiapetta et al.

(10) Patent No.: US 6,447,083 B1
(45) Date of Patent: Sep. 10, 2002

(54) REFRIGERATOR WITH PULL-OUT DOOR

(75) Inventors: Don Chiapetta, Kitchener; Samir Atalla, Oakville, both of (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/595,880

(22) Filed: Jun. 20, 2000

(30) Foreign Application Priority Data

Mar. 15, 2000 (CA) ..... 2300791

(51) Int. Cl.[7] ..... A47B 96/04
(52) U.S. Cl. ..... 312/404; 312/334.4
(58) Field of Search ..... 312/116, 122, 312/270.3, 334.1, 334.4, 334.5, 334.8, 334.19, 348.3, 348.4, 402, 404, 405.1, 408

(56) References Cited

U.S. PATENT DOCUMENTS 3,133,768 A * 5/1964 Klakovich ..... 312/334.8 X
3,212,835 A 10/1965 Beckett et al.
3,364,695 A 1/1968 Saunders et al.
3,490,823 A * 1/1970 Neu et al. ..... 312/270.3 X
4,317,607 A 3/1982 Gomolka
4,595,247 A 6/1986 Zank
4,662,186 A 5/1987 Park
4,751,826 A 6/1988 Kawahara et al.
5,056,332 A * 10/1991 Tajima et al. ..... 312/116 X
D326,461 S 5/1992 Nakao et al.
5,120,118 A 6/1992 Rankin
5,310,255 A * 5/1994 Ranallo ..... 312/334.1 X
5,758,512 A 6/1998 Peterson et al.
5,833,337 A * 11/1998 Kofstad ..... 312/334.5
5,918,959 A 7/1999 Lee

* cited by examiner

*Primary Examiner*—Peter M. Cuomo
*Assistant Examiner*—Michael J. Fisher

(57) ABSTRACT

There is disclosed a refrigerator having an insulated cabinet and a pull-out bottom drawer with an insulated door. The door is mounted to the end of a pair of telescopically extendable guide rails having a rail portion mounted inside the cabinet. A pair of mounting brackets mount the door to the guide rails in a manner that permits the door to be adjusted vertically and horizontally relative to the cabinet. The mounting brackets each have a side plate with four spaced apart apertures positioned adjacent vertically enlarged aligned apertures in the guide rail and through which pass threaded screws. A locking nut is threaded onto the screw to lock the bracket in place relative to the guide rails during assembly. The vertically extending enlarged apertures permit the bracket to be adjusted vertically relative to the rail. The mounting brackets each including a front plate extending inwardly at a right angle from the side plate. The front plate has four spaced apart horizontally enlarged apertures that align with apertures in the door liner and through which threaded screws pass. The horizontally enlarged apertures permit the door to horizontally slide relative to the mounting brackets to permit horizontal adjustment of the door relative to the guide rails and cabinet during door closure.

12 Claims, 6 Drawing Sheets

REFRIGERATOR WITH PULL-OUT DOOR

FIELD OF THE INVENTION

This invention relates to a refrigerator, and in particular a bottom mount refrigerator, having a vertically and horizontally adjustably mounted insulated pull-out door.

BACKGROUND OF THE INVENTION

In the last few years bottom mount refrigerators have been re-introduced in the marketplace. A bottom mount refrigerator has the fresh food compartment located vertically above the freezer compartment. The bottom freezer compartment is typically smaller than the top fresh food compartment.

Several different door mounting arrangements have been implemented to close the front access opening to the lower or bottom freezer compartment. In one arrangement the freezer door is mounted by hinge pins to the sidewall of the refrigerator compartment to allow the door to swing open about a vertical axis. In another door mounting arrangement the door drops or hinges about a horizontal axis.

In yet another mounting arrangement for a bottom drawer in a bottom mount refrigerator, a pull-out drawer type door moves horizontally relative to the refrigerator cabinet. In this arrangement, a door panel is secured to mounting rails that telescopically extend from the freezer cabinet to allow a front door panel to be pulled out and pushed in relative to the cabinet to respectively effect opening and closing of the freezer compartment. Typically, this pull-out door has a container in which food articles are held and are accessible to the user when the door is pulled out from the cabinet.

The problem with a pull-out door for a refrigerator cabinet is that the door is mounted directly to the telescopic arms of the guide rails and as a result, the positioning and securing of the guide rails within the cabinet is critical to the proper alignment of the front door panel to close the front access opening of the freezer compartment and effect a proper seal with the cabinet. In some instances the placement of the guide rails is not within horizontally tolerances and results in the door being slightly canted relative to the cabinet resulting in an poor seal of the closed door relative to the cabinet.

Accordingly, there is a need for an improved mounting assembly wherein the door is mounted to the cabinet in a manner that compensates for manufacturing assembly tolerances associated with the telescopic guide rails and cabinet so as to provide for an improved door seal and fit with the cabinet.

SUMMARY OF THE INVENTION

The present invention relates to a refrigerator cabinet having a pull-out lower food compartment insulated door that is mounted by a pair of mounting brackets to telescopically extendable guide rails. The guide rails are mounted within the cabinet. The mounting brackets each have a front plate which is secured against an inner liner of the insulated door and a side plate that is secured to a first rail end of the telescopically extendable guide rails. The use of this separate mounting bracket that is secured to both the door and one of the guide rails, permits for either vertical adjustment, horizontal adjustment, or both of the door relative to the cabinet of the refrigerator.

At least one of the side plates of the mounting brackets or the first rail ends of the guide rails cooperates with a fastener for permitting relative adjustable vertical movement between the side plate and the first rail end prior to securing the fastener. Alternatively, the first vertical adjustment may be achieved by at least one of the front plates of the mounting brackets or the inner liner of the door cooperating with a fastener for permitting relative adjustable vertical movement between the front plate and the inner liner prior to securing the fastener. The fastener may pass through aligned apertures in the side plate and the first rail end or the front plate and the inner liner. At least one of the side plate and cooperating first rail end or the front plate and inner liner has enlarged apertures permitting the relative movement between cooperating parts. This vertical adjustment may comprise one of the aligned apertures being slotted or enlarged in the vertical direction. This permits the fastener which passes through this vertically enlarged or slotted aperture to be slid along the slotted aperture thereby permitting relative vertical adjustment of the door to the telescopical guide rails. In one embodiment, the door and the bracket may be moved vertically. In the alternate embodiment, the door may be moved vertically adjustable relative to the bracket.

In accordance with another aspect of the present invention, the adjustment of the door horizontally relative to the telescopic guide rails is contemplated by at least one aligned aperture in the inner liner and the front plate of the mounting bracket having a horizontal enlarged or slotted aperture to permit for horizontal displacement of the door relative to the mounting brackets. A reinforcing plate of metal or plastic is positioned in the door against the liner adjacent the placement of the front plate. A threaded fastener, preferably a shoulder screw, passes through aligned apertures in the front plate, inner liner and reinforcing plate with the head of the screw resting flat adjacent or against the front plate first. The threaded portion of the screw fastener is secured to the apertures in the reinforcing plate. The unthreaded shoulder portion of the screw is able to slide horizontally within the horizontally enlarged or slotted apertures permitting relative horizontal movement of the door relative to the mounting bracket, guide rails and refrigerator cabinet. Thus the horizontal adjustment means of the present invention permits for horizontal displacement of the door relative to the cabinet during closing of the door so as to compensate for variations in the distance between the guide rails mounted to the refrigerator cabinet.

The preferred vertical adjustment is to have a vertically elongated slotted aperture in the first end rails of the guide rails which vertically slotted aperture is aligned with circular apertures in the adjacent side plates of the mounting brackets. A threaded fastener passes through the aligned apertures with the head of the screw resting flat adjacent or against the first end rail and a locking nut threaded onto the threaded stem secured against the side plate of the mounting bracket either directly or through a washer.

In the preferred embodiment, the horizontal adjustment of the door relative to the cabinet is achieved by the front plate of the mounting bracket having a horizontal elongated slotted aperture through which a fastening threaded screw passes with the head of the screw engaging a washer against the front plate. The inner liner has a supporting plate positioned behind and flush with the liner. The supporting plate has threaded apertures aligned with the aligned apertures of the inner liner and the horizontally slotted apertures of the front plate. The threaded apertures in the reinforcing plate receive the thread stem of the shoulder screws to fasten or lock the front plate against the inner liner of the door. In the preferred embodiment, the four sets of aligned apertures and threaded fasteners each mount the side plate to the end rail and the front plate to the inner liner.

It is within the realm of the present invention that the fastening means may alternately comprise a threaded stem extending from one of the mounting brackets and or a first end rail and inner liner passing through a corresponding slotted aperture in the mounting bracket front plate or side plate or the end rail and the liner.

The present invention has the advantageous feature of permitting vertical and/or horizontal adjustment of the door relative to the cabinet to compensate for improper door alignment with the cabinet as a result of potential guide rail assembly imperfections. Further, the use of the shoulder screw permits for relative horizontal adjustment of the door to the guide rails during door closing to permit for a proper and effective door seal.

In accordance with one aspect of the present invention there is provided a refrigerator comprising an insulated cabinet including at least one food compartment having opposing interior side walls and an open front. The refrigerator has an insulated door adapted to close the open front of the at least one food compartment. The insulated door has a inner liner facing the open front of the food compartment. A pair of telescopically extendable guide rails are each mounted to one of the opposing interior side walls and each have a first rail end adjacent the open front when the door is closed and that passes through the open front when the door is open. The refrigerator has a pair of mounting brackets for mounting the insulated door to the side rails such that the door slides into a sealing engagement with the cabinet across the open front when in the door is closed. The refrigerator has vertical adjustment means carried by at least one of the side plate and first rail end and cooperating with the first fastener means for permitting relative adjustable vertically movement between the side plate and the first rail end prior to securing the first fastener means. The mounting brackets each have a front plate secured by at least one second fastener means to the inner liner of the insulated door and a side plate secured by at least one first fastener means to the first rail end of a corresponding one of the pair of guide rails.

In accordance with another aspect of the present invention there is provided a refrigerator comprising an insulated cabinet including at least one food compartment having opposing interior side walls and an open front. The refrigerator has an insulated door adapted to close the open front of the at least one food compartment. The insulated door has a inner liner facing the open front of the food compartment. A pair of telescopically extendable guide rails are each mounted to one of the opposing interior side walls and each have a first rail end adjacent the open front when the door is closed and that passes through the open front when the door is open. The refrigerator has a pair of mounting brackets for mounting the insulated door to the side rails such that the door slides into a sealing engagement with the cabinet across the open front when the door is closed. The mounting brackets each have a side plate secured by at least one first fastener means to the first end rail and a front plate extending from the side plate. The front plate is secured by at least one second fastener means to the inner liner of the insulated door. The refrigerator includes horizontal adjustment means carried by at least one of the front plate and inner liner end and cooperating with the second fastener means for permitting relative adjustable horizontal movement between the front plate and the inner liner prior to securing the second fastener means.

In accordance with another aspect of the present invention there is provided a refrigerator comprising an insulated cabinet including at least one food compartment having opposing interior side walls and an open front. The refrigerator has an insulated door adapted to close the open front of the at least one food compartment. The insulated door has a inner liner facing the open front of the food compartment. A pair of telescopically extendable guide rails are each mounted to one of the opposing interior side walls and each have a first rail end adjacent the open front when the door is closed and that passes through the open front when the door is open. The refrigerator has a pair of mounting brackets for mounting the insulated door to the side rails such that the door slides into a sealing engagement with the cabinet across the open front when the door is closed. The mounting brackets each have a front plate secured by at least one second fastener means to the inner liner of the insulated door and a side plate secured by at least one first fastener means to the first rail end of a corresponding one of the pair of guide rails. The refrigerator has vertical adjustment means carried by at least one of the front plate and inner liner and cooperating with the second fastener means for permitting relative adjustable vertically movement between the front plate and the inner liner prior to securing the second fastener means.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
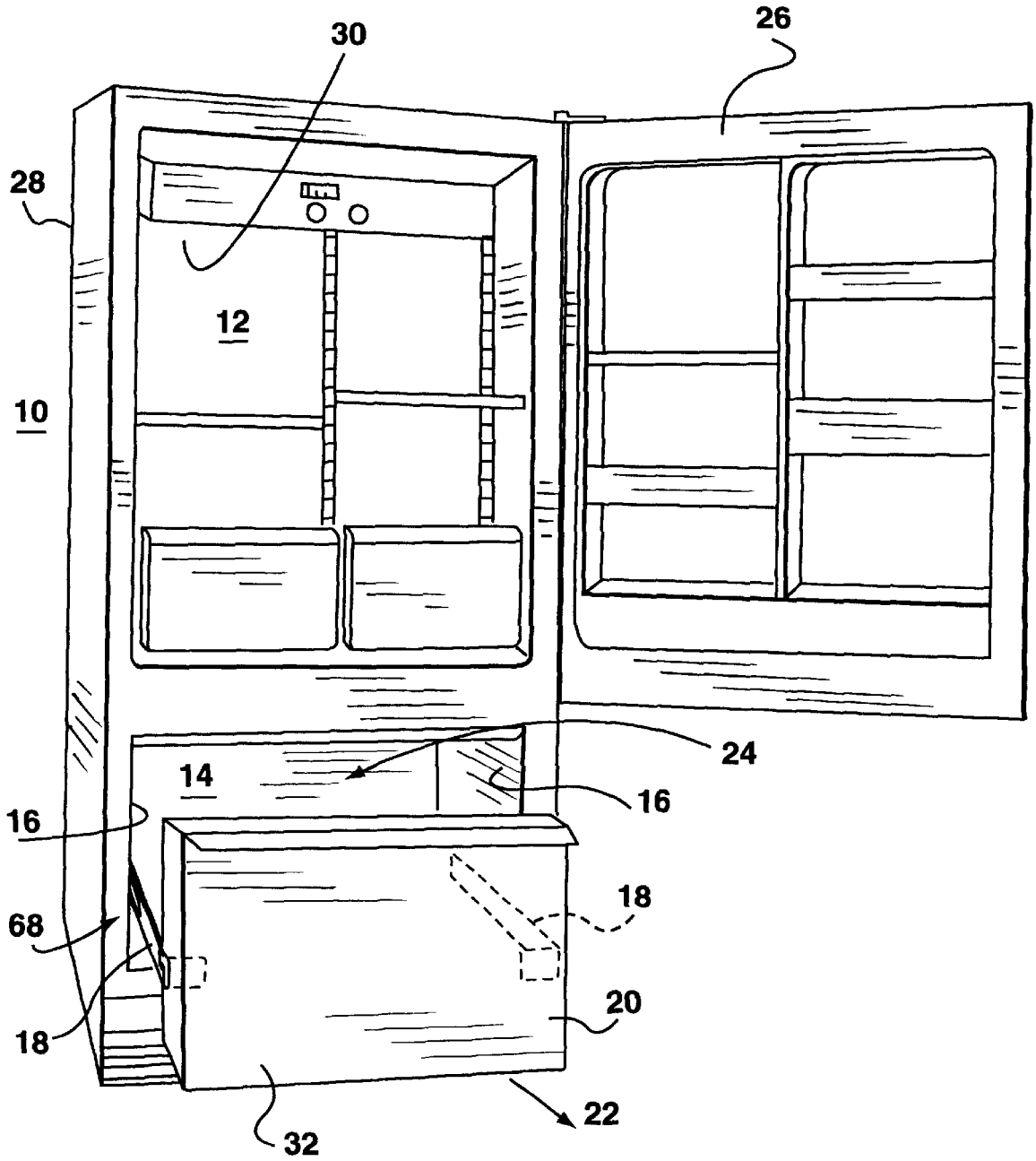
FIG. 1 is a front view of a bottom mount refrigerator having a pull-out door.

In FIG. 1, a bottom mount refrigerator has a cabinet 10 that has an upper fresh food compartment 12, closed by door 26, and a lower freezer compartment 14. The lower food or freezer compartment 14 has opposing interior side walls 16 to which are mounted telescopic guide rails 18 for supporting pull-out door 20. In FIG. 1 the pull-out door 20 is pulled in direction of arrow 22 to the open position shown where the door 20 extends across and is spaced forwardly of the open front 24 of compartment 14.

It should be understood that the insulated cabinet 10 typically comprises a metal outer shell 28 of a thin gauge of steel and an inner liner 30 which is spaced from the metal shell by insulation (not shown). The insulation is typically a foamed in place polyurethane insulation which expands to fill the gap between the outer shell 28 and inner liner 30. The cabinet inner liner 30 may be either metal or plastic.

The lower pull-out drawer door 20 also comprises an outer metal shell 32 and a door inner liner 34. The door liner 34 typically comprises a plastic material.

Figure 2:
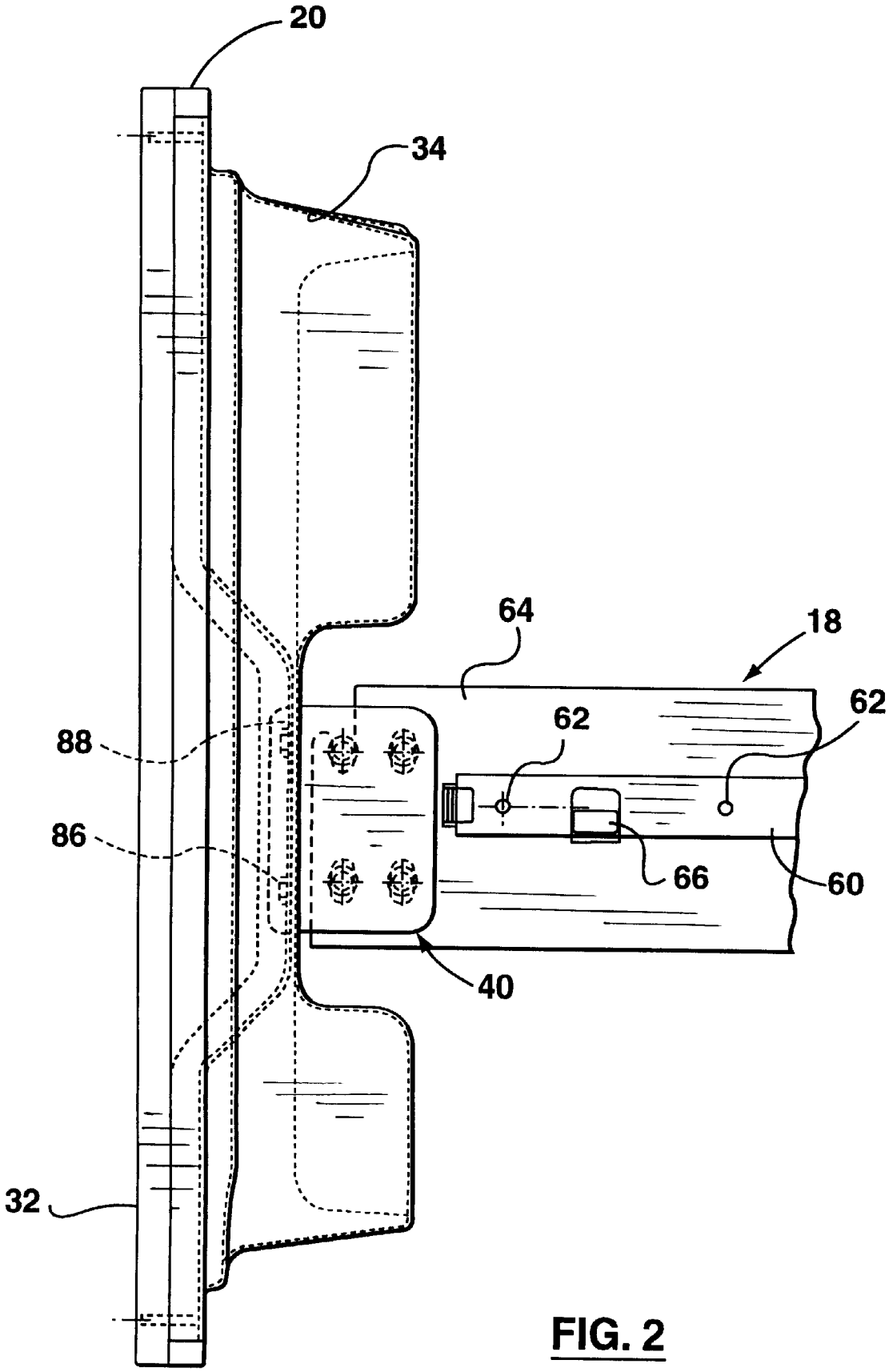
FIG. 2 is a side view showing the mounting of the door to one of the guide rails.
Figure 3:
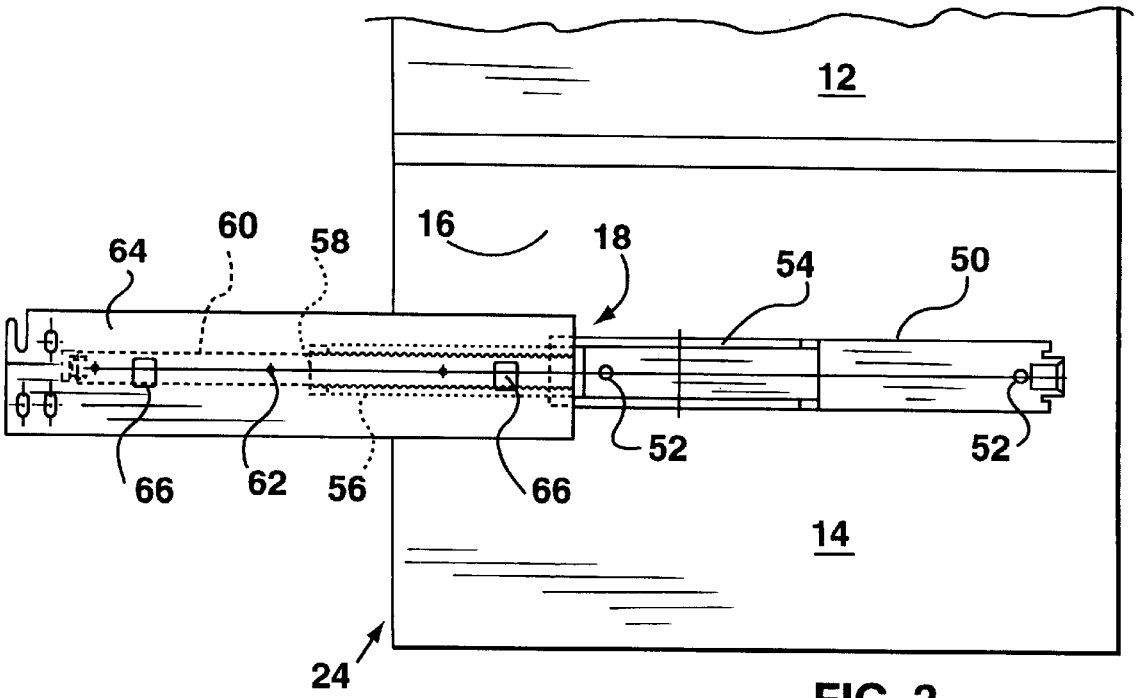
FIG. 3 is a side view of the guide rails mounted to the interior wall of the lower food compartment.

The door 20 is mounted with its inner liner 34 facing the open front 24 of the lower food compartment 14 by mounting brackets 40 and telescopic guide rails 18. Referring to FIGS. 1 through 5, the telescopic guide rails 18 comprise two opposing telescopic guide rails 18 mounted to a respective one of the opposing interior sidewalls 16 of the freezer compartment 14. The guide rails 18 as shown in FIG. 3, comprise a stationary portion 50 mounted by screws 52 to the interior side wall 16 of compartment 14. The stationary guide rails 50 each include a U-shaped bracket portion 54 at a forward end thereof adjacent the opening 24 of the compartment 14. The U-shaped bracket portion 54 of the stationary guide rail 50 receives an extending intermediate U-shaped guide bracket 56 that is adapted to slide within the U-shaped 54 of the stationary guide rail 50. The intermediate bracket 56 carries along it's central portion 58 a bar shaped rail 60 which is positioned and secured within the bracket 56. The rail 60 is attached by rivets 62 to a first rail end bracket 64. As shown in FIG. 3, the first telescopic guide rail 18 is fully extended such that the first rail end bracket 64 extends through the open front 24 of the lower food compartment 14. The first rail end bracket further has tabs 66 which extend inwardly and upwardly towards the interior of the food compartment 14 when the guide rail 64 is recessed directly within the compartment 14. To effect this, the intermediate bracket or rail portion 56 slides within the bracket 54 bringing the first end bracket 64 back within the open front 24 of the compartment 14.

Figure 9:
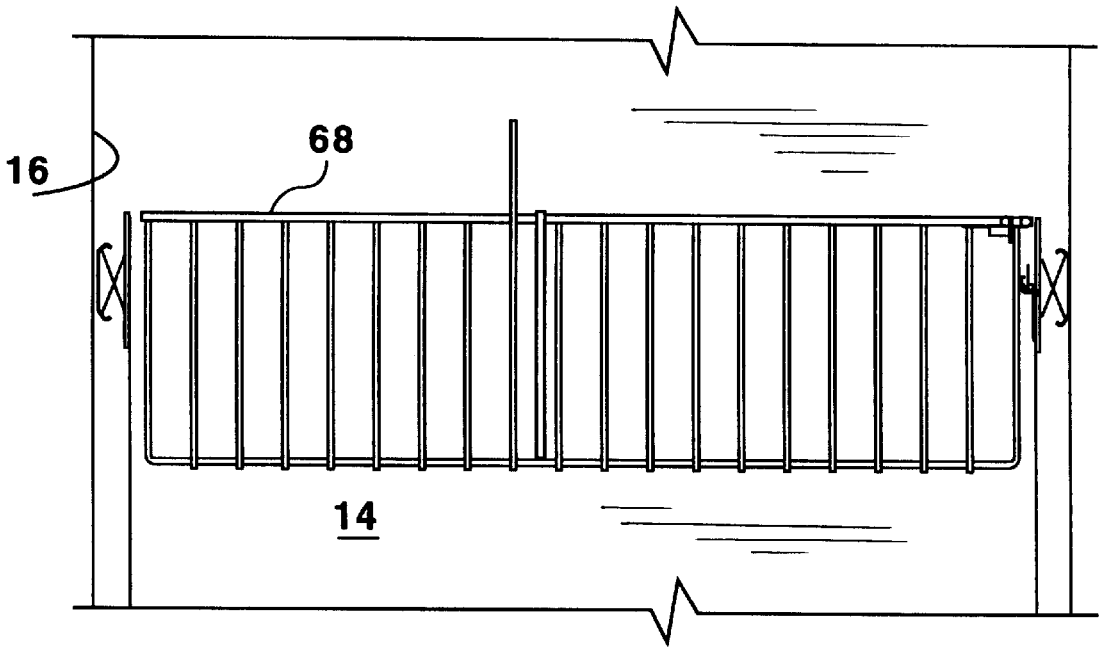
Figure 10:
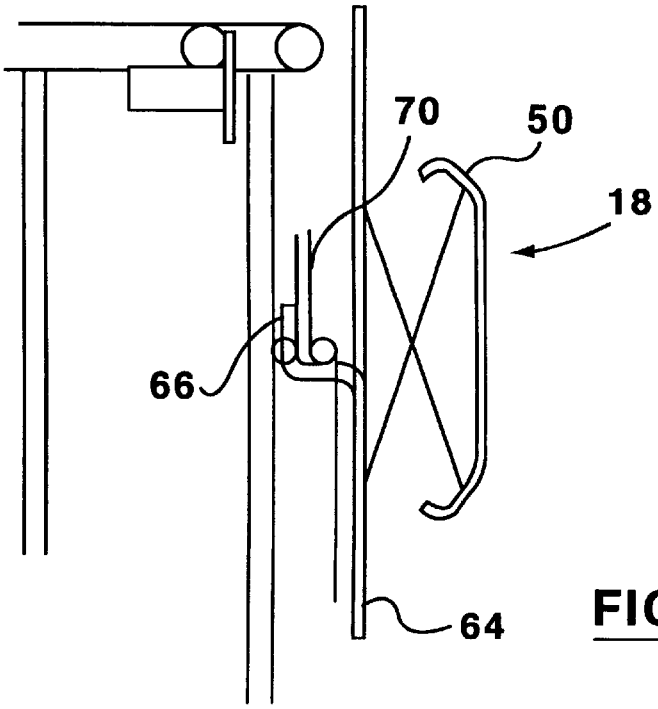

As shown in FIGS. 1, 9, and 10, a basket 68 extends between the guide rails 18 and has a shoulder or side arm supporting portion 70 that passes over and extends along the interior side walls 16 and is seated upon both of the tab members 66. The telescopic rails 18 support the basket 28 for supporting food articles.

Figure 4:
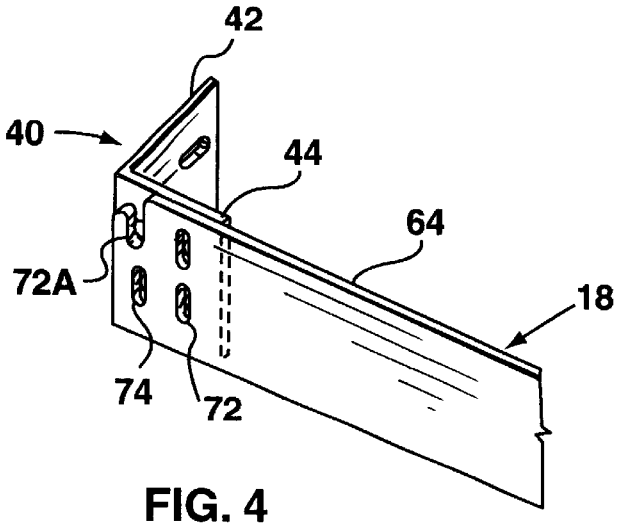
FIG. 4 is a partial perspective view of the guide rail positioned adjacent the mounting bracket.
Figure 4A:
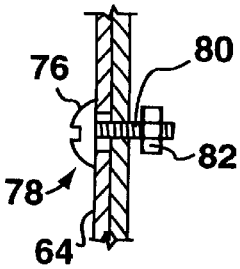
FIG. 4A is a side sectional view of the side plate of the mounting bracket attached to the first rail end.
Figure 5:
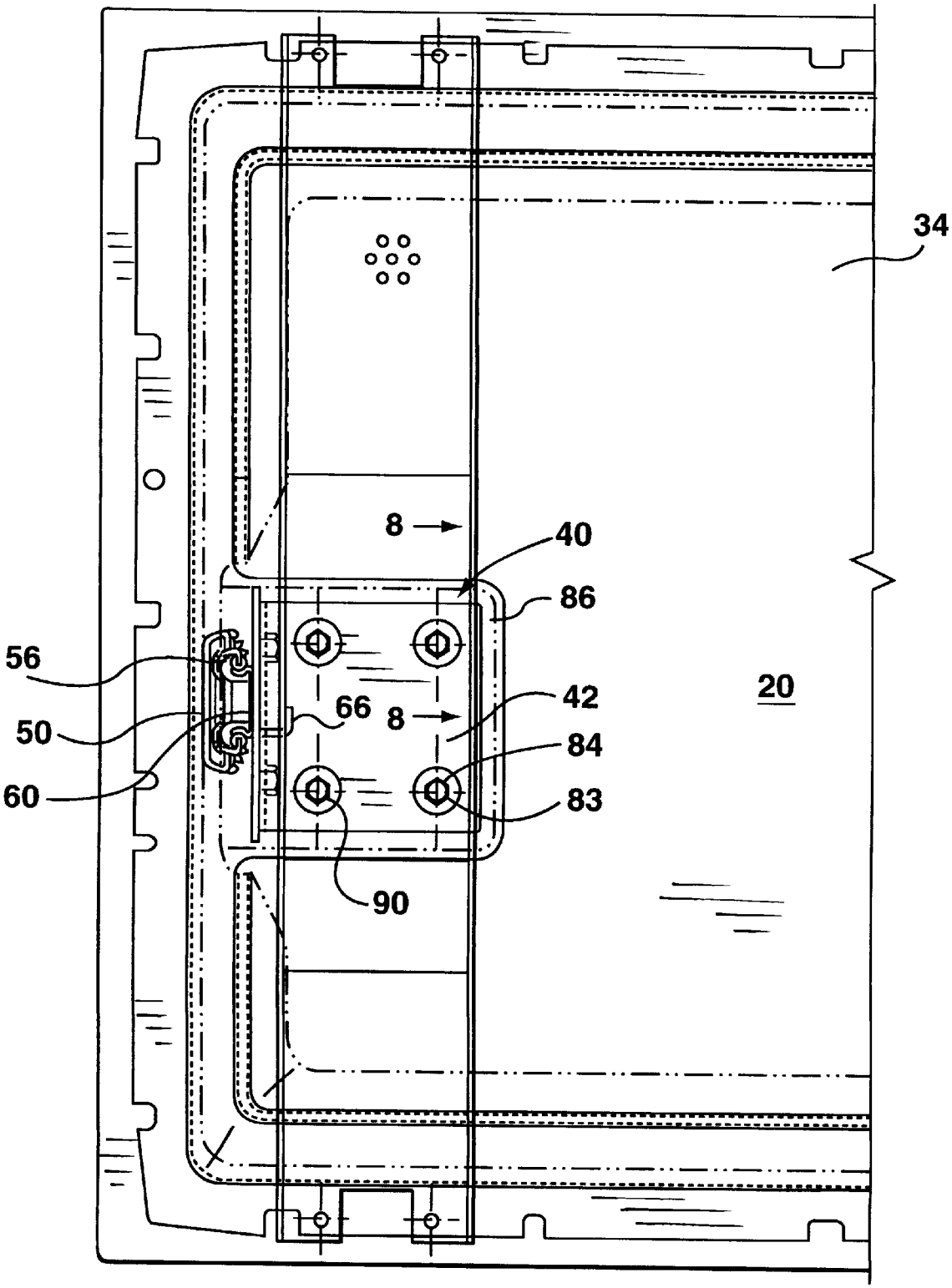
FIG. 5 a partial front view of the inner liner of the door and the front plate of the bracket.

To secure the door 20 to the guide rails 18, a pair of mounting brackets 40 are used. In FIGS. 2, 4, and 5, one of the mounting brackets 40 is shown to comprise a front plate 42 and a side plate 44. The front plate 42 is positioned at right angles relative to the side plate 44. The mounting brackets 40 comprise a steel material having a thickness in the order of ⅛ of an inch. The side plate 44 is secured to the first end rail 64. The first end rail 64 includes four apertures 72, 72A, which are slotted with a vertical extension. Three apertures 72 are shown for the rail 64. The rail 64 further includes an open slotted aperture 72A. The side plate 44 of the mounting bracket includes four circular apertures 74. The circular apertures 74 align with the slotted apertures 72 by placing the side plate 44 flush against the first end rail 64. Thereafter, a fastener in the form of a threaded screw 76 is passed through the aligned apertures and has a head for engaging the outside of the first rail 64. FIG. 4A shows the threaded screw 76. The threaded screw 76 has head 78 mounted adjacent the first end rail 64 and has a threaded stem 80 passing through the aligned apertures 72, 74 and a threaded locking nut 82 secures the fastener 76 in place thereby controlling the position of the first rail 64 relative to the side plate 44 of the mounting bracket 40. Due to the vertical extension of the slots or apertures 74, adjustment of the relative position of the fastening means within the slot is made possible and hence the relative vertical adjustment of the side plate 44 and the first end rail 64 is achieved.

Figure 8:
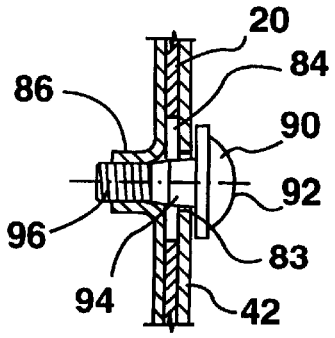
FIG. 8 is side sectional view taken at lines 8—8 of FIG. 5 showing the mounting of the front plate of the mounting bracket against the inner liner of the door; and, FIGS. 9 and 10 are diagrammatic views showing the mounting of the drawer container basket to the guide rails.

The brackets 40 are mounted to the inner liner 34 of the door 20 by the front plate 42. The front plate 42 has a series of slotted apertures 83 that are slotted in the horizontal direction. Behind these apertures 83 are corresponding apertures located in the liner 84. Behind the apertures 84 in the inner liner 20 is located a plate-like member 86 which acts as reinforcement to the liner 20. The plate like member of 86 also has apertures 88 contained therein through which threaded fasteners in the form of shoulder screws 90 pass. This fastening arrangement is shown more detail in FIG. 8 where the shoulder bolts 90 have a head 92 a shoulder portion 94 and a threaded stem portion 96. The threaded stem portion 96 engages the reinforcing plate 86 apertures and passes through the aperture 84 of the liner 20 and the horizontally slotted aperture 83 of the front plate 42. In this fashion the four spaced apart apertures and threaded shoulder bolts 90 act to secure the front plate 42 of the bracket 40 to the door 20. The horizontal slot in the front plate apertures permits for the relative horizontal positioning of the door 20 relative to the mounting bracket 40.

Consequently, when the door 20 is mounted on to the guide rails 18 through the mounting bracket 40, the vertical adjustment of the door 20 relative to the guide rails 18 and the cabinet 10 is accomplished by the vertical alignment or adjustment of the side plate 44 and the first rail 64 adjustment means as discussed above. With respect to the door 20, it can also be horizontally adjusted relative to the front plate 42 of the bracket 40 by means of the horizontal slots contained in the front plate 40. Consequently, a door 20 may be readily mounted and adjusted for proper sealing against the cabinet 10 to close the open front 24 of the cabinet or food compartment 14 when the door is closed.

Figure 6:
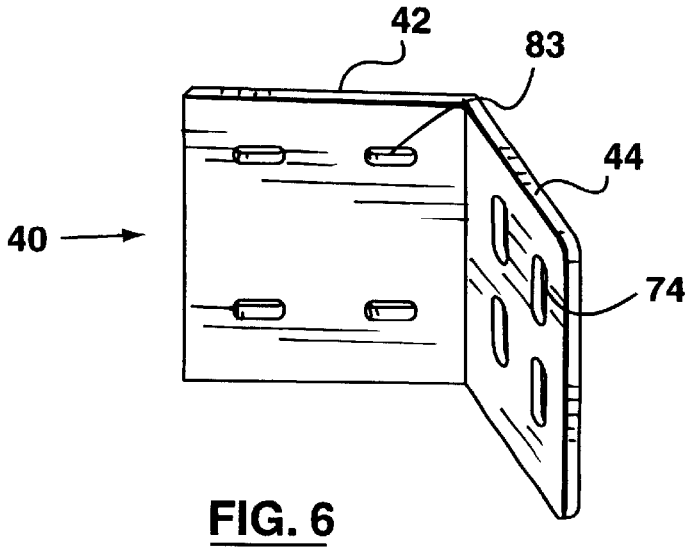
FIGS. 6 and 7 are perspective views of different embodiments of the mounting bracket.

Referring to FIG. 6 there is shown an alternate embodiment for the mounting bracket having horizontal slots 83 in the front plate 42. However, instead of the first end rail including the vertically extending slots 72 the apertures 74 of the side plate 44 of the mounting bracket 42 show the slot 74 to be vertically extending. Consequently, in the alternative embodiment either the first rail 64 or the end plate 44 includes the vertical slots to provide for vertical adjustment.

Figure 7:
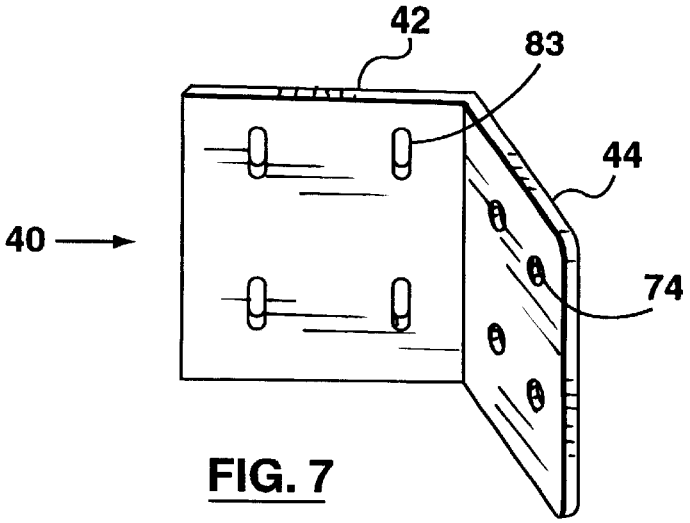

Referring to FIG. 7, the front plate 42 is shown to include vertical slots which would then permit the door 20 to be mounted vertically relative to the bracket 40. In this embodiment, it shows an alternative vertical adjustment means which is formed on the front plate 42 of the bracket 40 instead of on the side plate 44. The side plate 44 has circular apertures 74 thereby not permitting for any vertical relative movement of the side plate 44 relative to the first end rail 64 when the first end rail 64 have circular apertures.

Certain preferred embodiments of the invention have been described in detail. From a reading of this disclosure, obvious modifications will be evident to those skilled in the art without departing from the spirit of the invention disclosed or from the scope of the appended claims.

What we claim is:

1. A refrigerator comprising:

an insulated cabinet including at least one food compartment having opposing interior side walls and an open front;

an insulated door adapted to close the open front of the at least one food compartment, the insulated door having an outer shell, an inner liner facing the open front of the food compartment, and a pair of reinforcing support plates located within the door against a portion of the inner liner, the inner liner and reinforcing support plates having aligned apertures with the reinforcing support plate apertures having threads;

a pair of telescopically extendable guide rails each mounted to one of the opposing interior side walls and each having a first rail end adjacent the open front when the door is closed and passing through the open front when the door is open;

a pair of mounting brackets for mounting the insulated door to the side rails such that the door slides into a sealing engagement with the cabinet across the open front when the door is closed, the mounting brackets each having a side plate secured by at least one first fastener means to the first rail end of a corresponding one of the pair of guide rails, and the mounting brackets each having a front plate having at least one mounting aperture through which passes a shoulder screw fastener means, the shoulder screw fastener means having a head mounted against the front plate, an unthreaded shoulder passing through the aperture of the liner, and a threaded stem secured within the threaded aperture of the reinforcing support plates to secure the front plate against the inner liner of the insulated door; and, vertical adjustment means carried by at least one of the side plate and first rail end and cooperating with the first fastener means for permitting relative adjustable vertical movement between the side plate and the first rail end prior to securing the first fastener means.

2. The refrigerator of claim 1 wherein the vertical adjustment means comprises at least one first pair of aligned apertures in the side plate and the corresponding first rail end through which the first fastener means passes to secure the side plate to the first rail end and one of the first pair of aligned apertures having a vertically extending slot permitting vertical adjustment of the side plate relative to the first rail end.

3. The refrigerator of claim 2 further including horizontal adjustment means carried by the front plate cooperating with the shoulder screw fastener means for permitting relative adjustable horizontal movement between the front plate and the inner liner.

4. The refrigerator of claim 2 wherein the guide rails each include support tabs directed inwardly into the food compartment, and the refrigerator further including a food container having a shoulder adapted to rest on the support tabs for sliding with the telescopic rails out through the open front of the food compartment when the door is open.

5. The refrigerator of claim 1 further including horizontal adjustment means carried by the front plate and cooperating with the shoulder screw fastener means for permitting relative adjustable horizontal movement between the front plate and the inner liner.

6. The refrigerator of claim 5 wherein the horizontal adjustment means comprise at least one second pair of aligned apertures in the front plate and the corresponding inner liner through which the second fastener means passes to secure the front plate against the inner liner and one of the second pair of aligned apertures having a horizontally extending slot permitting horizontal adjustment of the front plate relative to the inner liner.

7. The refrigerator of claim 5 wherein the guide rails each include support tabs directed inwardly into the food compartment, and the refrigerator further including a food container having a shoulder adapted to rest on the support tabs for sliding with the telescopic rails out through the open front of the food compartment when the door is open.

8. The refrigerator of claim 1 wherein the guide rails each include support tabs directed inwardly into the food compartment, and the refrigerator further including a food container having a shoulder adapted to rest on the support tabs for sliding with the telescopic rails out through the open front of the food compartment when the door is open.

9. A refrigerator comprising:

an insulated cabinet including at least one food compartment having opposing interior side walls and an open front;

an insulated door adapted to close the open front of the at least one food compartment, the insulated door having an outer shell, an inner liner facing the open front of the food compartment, and a pair of reinforcing support plates located within the door against a portion of the inner liner, the inner liner and reinforcing support plates having aligned apertures with the reinforcing support plate apertures having threads;

a pair of telescopically extendable guide rails each mounted to one of the opposing interior side walls and each having a first rail end adjacent the open front when the door is closed and passing through the open front when the door is open; and, a pair of mounting brackets for mounting the insulated door to the side rails such that the door slides into a sealing engagement with the cabinet across the open front when the door is closed, the mounting brackets each having a side plate secured by at least one first fastener means to the first end rail and a front plate extending from the side plate, the front plate having at least one mounting aperture throughwhich passes a shoulder screw fastener means, the shoulder screw fastener means having a head mounted against the front plate, an unthreaded shoulder passing through the aperture of the liner, and a threaded stem secured within the threaded aperture of the reinforcing support plates to secure the front plate against the inner liner of the insulated door; and, horizontal adjustment means carried by the front plate and cooperating with the shoulder screw fastener means for permitting relative adjustable horizontal movement between the front plate and the inner liner.

10. The refrigerator of claim 9 wherein the guide rails each include support tabs directed inwardly into the food compartment, and the refrigerator further including a food container having a shoulder adapted to rest on the support tabs for sliding with the telescopic rails out through the open front of the food compartment when the door is open.

11. A refrigerator comprising:

an insulated cabinet including at least one food compartment having opposing interior side walls and an open front;

an insulated door adapted to close the open front of the at least one food compartment, the insulated door having an outer shell, an inner liner facing the open front of the food compartment, and a pair of reinforcing support plates located within the door against a portion of the inner liner, the inner liner and reinforcing support plates having aligned apertures with the reinforcing support plate apertures having threads;

a pair of telescopically extendable guide rails each mounted to one of the opposing interior side walls and each having a first rail end adjacent the open front when the door is closed and passing through the open front when the door is open;

a pair of mounting brackets for mounting the insulated door to the side rails such that the door slides into a sealing engagement with the cabinet across the open front when in the door is closed, the mounting brackets each having a side plate secured by at least one first fastener means to the first rail end of a corresponding one of the pair of guide rails, and the mounting brackets each having a front plate having at least one mounting aperture throughwhich passes a shoulder screw fastener means, the shoulder screw fastener means having a head mounted against the front plate, an unthreaded shoulder passing through the aperture of the liner, and a threaded stem secured within the threaded aperture of the reinforcing support plates to secure the front plate against the inner liner of the insulated door; and, vertical adjustment means carried by the front plate and cooperating with the shoulder screw fastener means for permitting relative adjustable vertical movement between the front plate and the inner liner prior to securing the shoulder screw fastener means.

12. The refrigerator of claim 11 wherein the vertical adjustment means comprises a vertical extending slot portion in the front plate throughwhich the shoulder screw fastening means pass to permit vertical adjustment of the front plate relative to the inner liner.

* * * * *